United States Patent [19]

Beer et al.

[11] 4,243,200

[45] Jan. 6, 1981

[54] FORM PAN STRUCTURE

[75] Inventors: Issie M. Beer; Zenon A. Zielinski; Henry Finkel, all of Montreal, Canada

[73] Assignee: Beer-Zaz Building Systems, Inc., Quebec, Canada

[21] Appl. No.: 861,571

[22] Filed: Dec. 16, 1977

[51] Int. Cl.[3] ..... B28B 7/28; E04G 11/46

[52] U.S. Cl. ..... 249/187 R; 249/28; 249/29; 249/31; 249/32; 249/177; 249/184; 249/186

[58] Field of Search ..... 249/177, 28, 29, 30, 249/31, 32, 187 R

[56] References Cited

U.S. PATENT DOCUMENTS

| | | | |
|---|---|---|---|
| 856,852 | 6/1907 | Dorward | 249/177 |
| 875,518 | 12/1907 | Georgenson | 249/177 |
| 1,131,479 | 3/1915 | Dale | 249/29 |
| 1,305,299 | 6/1919 | Marqua | 249/29 |
| 1,507,046 | 9/1924 | Cockerell et al. | 249/29 |
| 1,530,851 | 3/1925 | Paul | 249/177 |
| 1,713,100 | 5/1929 | Soule | 249/177 |
| 1,846,194 | 2/1932 | Goldsmith | 249/177 |
| 1,891,557 | 12/1932 | Roos | 249/31 |
| 2,775,019 | 12/1956 | Bemis | 249/30 |
| 3,157,966 | 11/1964 | Sherburne | 249/177 |
| 3,224,725 | 12/1965 | Matteson | 249/28 |
| 3,488,027 | 1/1970 | Evans | 249/28 |
| 4,003,542 | 1/1977 | Beer et al. | 249/31 |
| 4,023,765 | 5/1977 | Kinnamon | 249/29 |

*Primary Examiner*—Theodore Morris
*Assistant Examiner*—Arthur H. Koeckert
*Attorney, Agent, or Firm*—Guy J. Houle; Alan Swabey; Robert E. Mitchell

[57] ABSTRACT

A form pan section comprising a top wall and opposed side walls depending from a respective opposed side of the top wall. A support flange is provided along a free edge of each of the side walls. The support flange has a load supporting bearing section. Means is provided in each of the support flanges to secure the flange to supporting framework. Connection means is provided inwardly of the top wall and side walls to interconnect the pan section to another pan section. A form pan is constructed of at least two end pan sections having the above-described characteristics.

5 Claims, 6 Drawing Figures

Fig. 4
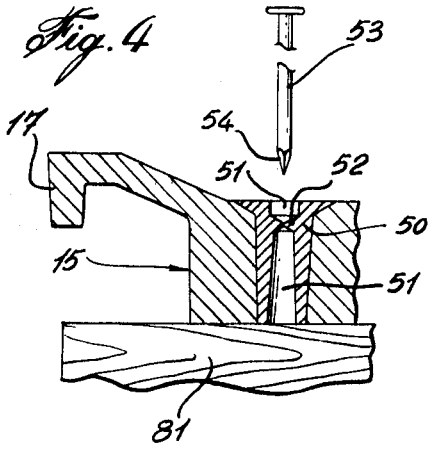
Fig. 5
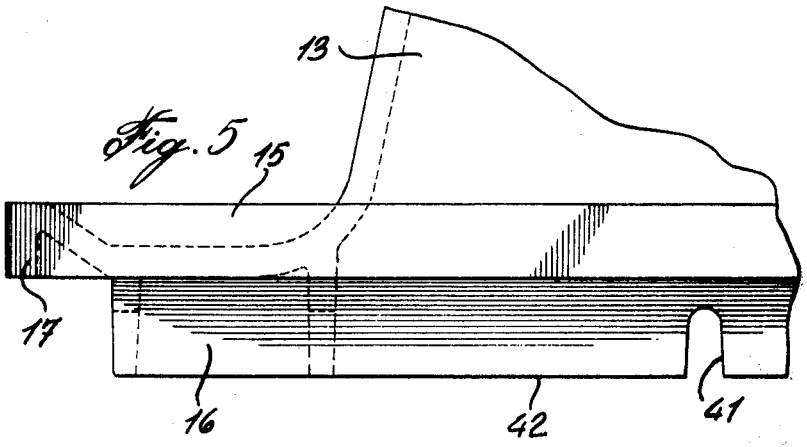
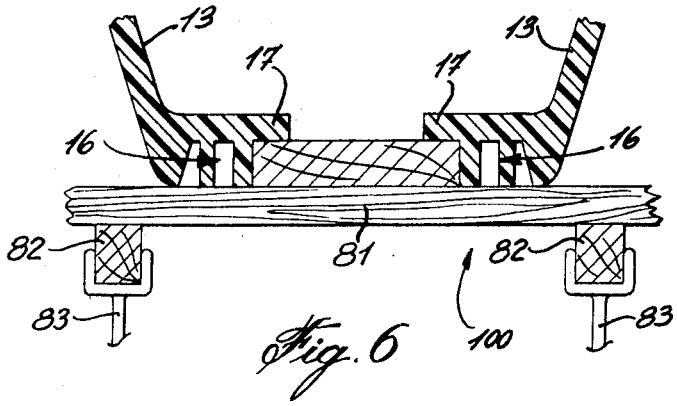
Fig. 6

FORM PAN STRUCTURE

BACKGROUND OF INVENTION (a) Field of the Invention

The present invention relates to an improved form pan construction and more particularly to a form pan made of sections and being of the reusable, stackable and interchangeable type.

(b) Description of Prior Art

Form pans generally of the section type construction are known. However, a major disadvantage of section type form pans is that these require complex support framework for installation and it is necessary to secure fastening clips or similar type elements to the framework in order to retain the form pans onto the framework. Also, the sections forming a complete form pan are not securely interlocked with one another and will sometimes deform or shift during the application of a load onto the form pan such as the pouring of a concrete, etc. A still further disadvantage of known section type form pans is that it is difficult to dismantle the framework after a concrete slab has been set over the form pans and to salvage the pans without damage thereto. A still further disadvantage is that the form pans are not suitably secured for use on a flying form type of support framework structure as the pans are not positively connected to the framework or to one another and require special shoring devices.

SUMMARY OF INVENTION

It is a feature of the present invention to provide a section type form pan structure which substantially overcomes the above-mentioned disadvantages.

A further feature of the present invention is to provide a form pan section which is positively interconnectable with other form pan sections and to a support framework.

A further feature of the present invention is to provide a form pan section which is nestable with other form pan sections which are rigid in structure, and yet lightweight.

A further feature of the present invention is to provide a form pan constructed of at least two end pan sections whereby a form pan can be constructed of any desired length.

According to the above features, from a broad aspect, the present invention provides a form pan section comprising a top wall and opposed side walls depending from a respective opposed side of the top wall. A support flange is provided along a free edge of each of the side walls. The support flange has a load supporting bearing section. Means is provided in each of the support flanges for securing the flange to supporting framework. Connection means is also provided inwardly of the top wall and side walls to interconnect the pan section to another pan section.

According to a further broad aspect of the present invention, there is provided a form pan comprising one or more intermediate pan sections and opposed end pan sections. Each pan section has a top wall and opposed parallel side walls depending from a respective opposed side of the top wall. A support flange is provided along a free edge of each of the side walls. The support flange has a load supporting bearing section. Means is provided in each of the support flanges for providing securement thereof to supporting framework. The end pan sections have an end wall extending between the parallel side walls and depending from an end of the top wall and having an end support flange. Connection means is provided inwardly of the top wall to interconnect the open ends of the pan sections to constitute a form pan.

BRIEF DESCRIPTION OF DRAWINGS

A preferred embodiment of the present invention will now be described with reference to the accompanying drawings in which:

FIG. 4 is a section view illustrating the securement means in the flange;

FIG. 5 is a fragmented side view illustrating the configuration of a support flange;

FIG. 6 is a section view illustrating a feature of the support flange as used with a span element.

DESCRIPTION OF PREFERRED EMBODIMENTS

Figure 1:
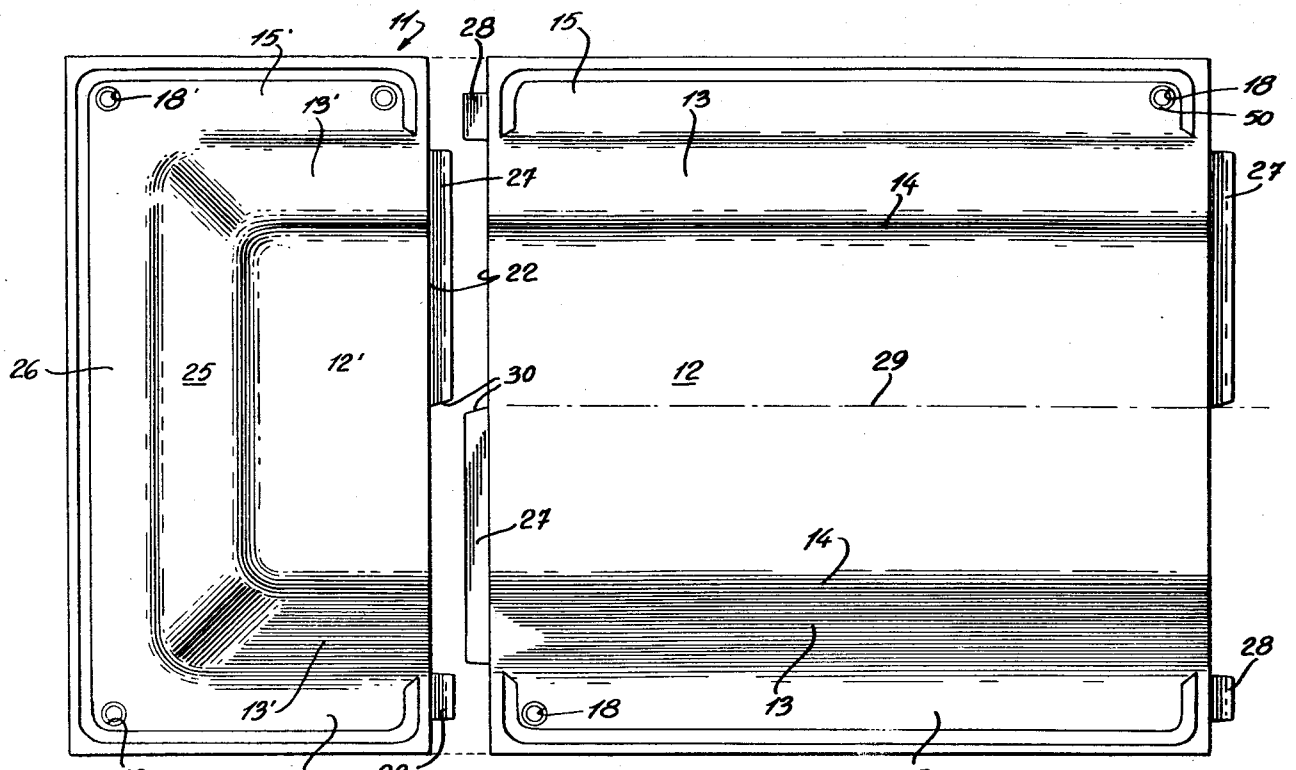
FIG. 1 is a top view of an intermediate and end pan section.
Figure 7:
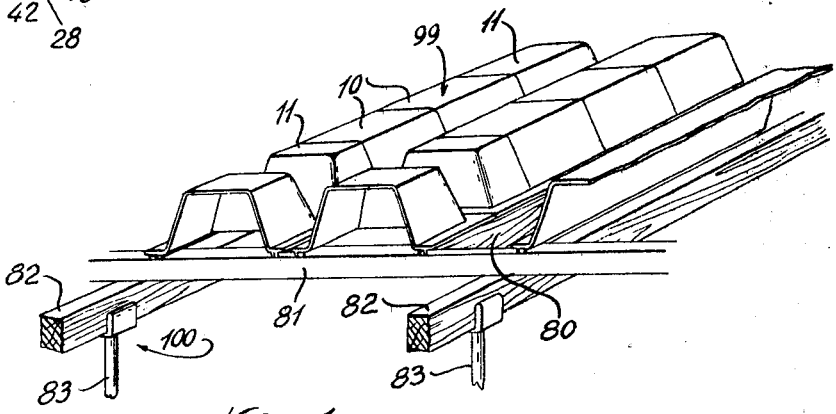
FIG. 7 is a perspective fragmented view illustrating a plurality of form pans interconnected to one another on a support framework.

Referring now to the drawings, and more particularly to FIG. 1, there is shown form pan sections 10 and 11 which constitute the construction of a section form pan 99 as shown in FIG. 7 and comprising one or more intermediate pan sections 10 extending between opposed end pan sections 11.

As shown in FIG. 1, the intermediate pan section 10 has a top wall 12 and opposed side walls 13 which depend from a respective opposed side 14 of the top wall 12. A support flange 15 extends along a free edge of each of the side walls 13. The support flange has a load supporting bearing section 16 (see FIG. 3) and an elevated end flange section 17, the purpose of which will be described later.

Means is provided in the support flange 15 in the form of a through bore 18 to secure the flange 15 and hence the form pan section 10 to supporting framework 100 as illustrated in FIGS. 6 and 7.

Figure 2:
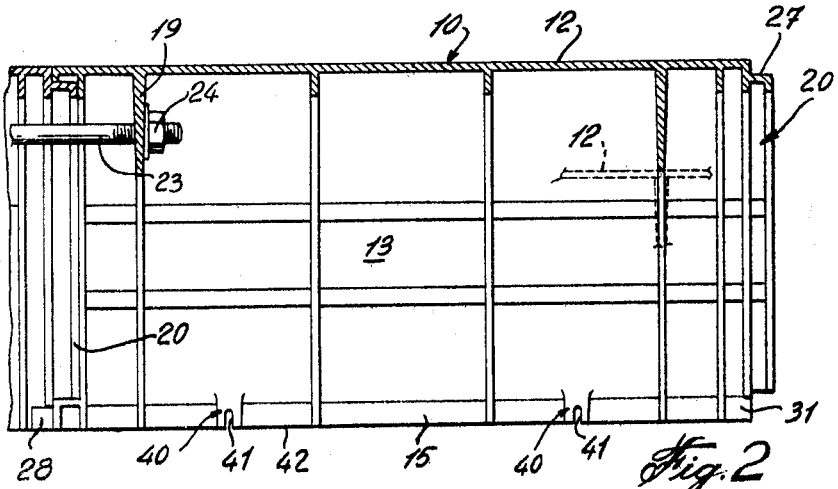
FIG. 2 is a section view of an intermediate pan section.

The form pan sections 10 and 11 are molded of a suitable rigid plastic material and are provided with ribs 98 oriented to impart rigidity to the form pan section. In order to constitute an assembled form pan, such as form pan 99 shown in FIG. 7, it is necessary to interconnect the intermediate pan sections 10 and the end pan sections 11 together. This is accomplished by providing connection means in the form of an attachment element, herein bore or slot 21 in a transverse rib 19, which is formed with the pan section adjacent an open end 20 as shown in FIG. 2. Of course, other type attachment elements may be connected to the rib 19. The bore or slot 21 receives a fastener, herein a span bolt 23 having a threaded nut 24 at opposed ends thereof, whereby to interconnect the peripheral edges 22 of adjacent pan sections in tight bearing contact. The attachment rib 19 also constitutes a spacer rib whereby to abut against a top wall 12 of a further pan section when the pan sections are stacked one on top of each other when the assembled pans or sections are not in use, for transportation or storage of the pans, see FIG. 2.

As shown in FIG. 1, the end pan sections 11 are formed like the intermediate sections 10 with the exception that they are provided with an end wall 25 which extends between the parallel side walls 13' and depends from an end of the top wall 12' opposite to the open end 20. A support flange 26 also extends along the free end of the end wall 25 and is formed with the support flanges 15'. The securement through bores 18' are also provided in the peripheral flanges 15' or 26.

In order to align the peripheral edges 22 of form pan sections 10 and 11 to form a rigid connection with a good seal and to facilitate alignment to interconnect them to make a form pan, (such as 99 in FIG. 7) there is provided alignment means in the form of alignment ribs 27 and 28 extending outwardly from under the peripheral edge 22 of the open ends 20. As shown in FIG. 1, the alignment rib 27 is quite large and extends substantially half the width of the top wall 12. There is an alignment rib 27 along opposed peripheral edges 22 of an intermediate pan section 10 and disposed on a respective side of the central longitudinal axis 29 of the pan section 10. Also, one end edge 30 of each alignment rib 27 is bevelled whereby to facilitate mating alignment of the edges. The alignment ribs 28 are provided in the support flange 15 and are dimensioned to fit in a cavity 31 of an adjacent form pan section 10 or 11. Thus, the form pan sections 10 and 11 are substantially perfectly aligned for tight frictional fit when secured by the said connection means 23.

Figure 3:
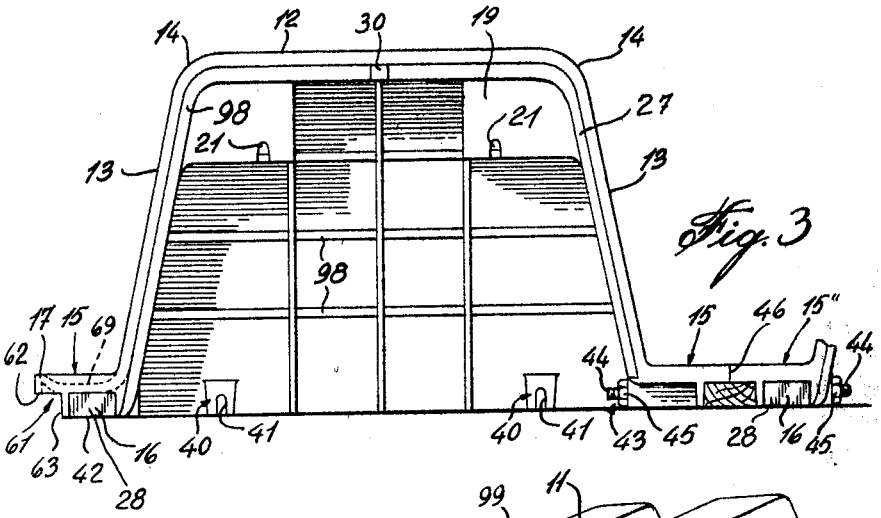
FIG. 3 is a section view of an end section showing the manner of attachment to a further end section positioned side-by-side.

As shown more clearly in FIGS. 2 and 3, further attachment elements 40 are provided transversely to the support flange 15 and are in the form of open-ended slots 41 opening in the load support bearing surface 42 of the support flange 15. These slots 41 permit passage of a fastener element 43 therethrough to permit attachment of adjacent pan sections positioned with their side walls 13 in a side-by-side manner. A detail of this side-by-side attachment is illustrated in FIG. 3 where there is shown the fastener element 43 which consists of a threaded bolt 44 having threaded nuts 45 at opposed ends thereof to apply clamping pressure against the peripheral edge 46 of opposed support flanges 15 and 15". Thus, the pan sections can be rigidly and positively secured in a side-by-side relationship to one another. These attachment elements 40 are also provided in the end flanges 26 of the end pan sections 11 whereby the end pans of adjacent form pans such as 99 may be connected end-to-end. Thus, the section pans 99 may be interconnected in transverse directions.

Referring now to FIG. 4, there is shown a detailed construction of the through bore 18 which constitutes the means to provide securement of the support flange 15 to support framework 100. As hereinshown, a removeable insert element 50 is positioned in the through bore 18. The through bore and the insert element 50 have an inwardly downward taper to permit insertion of the insert 50 on one side only of the support flange 15. Also, the insert 50 has a through bore cavity 51 therein with a thin membrane 52 extending across the bore 51. A fastener element such as a nail 53 is driven through the bore 51 and membrane 52 to secure the flange 15 on a framework 100 which is only constituted by a wooden member. The membrane 52 will deform and frictionally engage about the outer periphery of the nail 53 whereby when the nail 53 is removed after the pan has been taken away from the said concrete formed thereover, the nail and insert are easily removed by applying a force from the end 54 of the nails to cause the insert 50 and nail 53 to dislodge from the through bore 18 in the support flange 15. The purpose of the insert 50 is to protect the through bore 18 from being damaged by the fastener or nail 53 and to provide a good seal around the nail. Thus, the longevity of the support flange 15 and hence the form pan section is prolonged by preventing damage in the securing of these sections to a framework.

As previously disclosed, the support flange 15 has an elevated end flange section 17 which lies in a plane above the bearing surface 42 of the load supporting bearing section 16. Referring to FIG. 6, the use of the elevated end flange section 17 is herein illustrated. When it is necessary to position form pans, such as 99, in side-by-side relationship but spaced-apart whereby to provide a larger width concrete beam between adjacent form pans, a span element 80 (generally a plywood board of $\frac{3}{4}$ inch) is supported over a cross beam 81 supported on framework supports 82. The span element fits snugly under the elevated end flange section 17 of opposed form pans 99'.

As shown more clearly in detail in FIGS. 3 and 5, an open peripheral channel 61 is defined between an underface 62 of the elevated end flange section 17 and an outside wall 63 of the load supporting bearing section 16. This channel 61 overlaps a peripheral edge section 64 of the span element 60 which is positioned between adjacent support flanges of adjacent assembled form pans 99'. It is pointed out that the nail 53 extending through the support flanges 15 of the adjacent form pans will prevent lateral displacement of the span element 60, thus interlocking that span element in the framework.

Also, with reference to FIG. 3, it can be seen that a channel 69 is defined between the side wall 13 and also the end wall 25 of an end pan section 11. Thus, when concrete is set and the pans are removed a channel (not shown) will be formed in the concrete whereby to conceal the joint in the cement formed at the matting edges of flanges 15 of adjacent pans.

As illustrated in FIG. 7, it can be seen that this type of section form pans are quite useful in a flying form type structure as the form pans are all interconnected to one another and as well are interconnected to the framework which is itself rigidly attached to the form pans. Thus, an entire section of a form structure can be displaced without disturbing the form pans attached to the framework. Also, the securement means provides quick attachment of the pans onto the framework permitting a faster erection of formwork and a faster disassembly thereof. In a bolted type form structure the support posts 83 would connect or support the cross beam 81, directly.

The form pan sections defined above can be utilized to form pans for use in a concrete joist floor span section, as shown in FIG. 7, or in a waffle floor system. Of course, the forms are usable to precast slabs for various uses and may further be used in vertical wall forms.

When used in waffle form work only two end pan sections are interconnected together to form a square pan which may be used in either direction and interconnectable to one another in the same manner described above.

It is within the ambit of the present invention to provide any obvious modifications of the preferred embodiment described hereinabove, provided such modifications fall within the ambit of the broad claims appended hereto. Also, the form pan has many other applications not mentioned herein.

We claim:

1. A re-usable form pan section usable with other form pan sections to define an elongated form pan presenting a smooth continuous molding surface for the full length thereof, said form pan section being constructed of molded plastic material and comprising a top wall, opposed side walls depending angularly outwardly from a respective side edge of said top wall, and a support flange extending outwardly along a bottom free edge of each of said side walls, each of said support flanges including a structural rib-like load supporting bearing section adjacent the respective side wall in underlying relation to a form defining top face, said load supporting bearing sections being capable of freely supporting a vertical load, structural ribs lying in vertical planes formed integral with inner surfaces of said top and side walls and imparting rigidity to said top and side walls to resist vertical and horizontal distortion when said top and side walls are subjected to loads, said form pan section having at least one open end, connecting means adjacent said open end inwardly of said top and side walls for connecting said one open end of said form pan section to a like open end of another form pan section as a longitudinal extension thereof and in end-to-end abutting relation and with outer surfaces of said top and side walls forming continuations of one another, and alignment means projecting from said open end for interlocking said form pan section with another form pan section in axial alignment therewith, said alignment means including an axial projection on said top wall below the thickness thereof for engagement below the under surface of a top wall of another form pan section and an axial projection on one of said support flanges for engagement within a support flange of another form pan section, said axial projection of said top wall being offset to one side of a longitudinal center of said top wall whereby like axial projections of another form pan section may engage said open end of said form pan section.

2. A form pan section according to claim 1 wherein said axial projections are disposed on opposite sides of said longitudinal center.

3. A form pan section according to claim 1 wherein said axial projection of said top wall has a side edge disposed immediately adjacent said longitudinal center for centering edge abutting engagement with a like axial projection side edge of another form pan section.

4. A form pan section according to claim 1 wherein said connecting means includes an inwardly projecting connecting rib in each corner between one of said side walls and said top wall adjacent said one end and in longitudinally spaced relation thereto, said connecting ribs extending inwardly beyond said structural ribs and forming spacer means between stored stacked form pan sections.

5. A re-usable form pan section usable with other form pan sections to define an elongated form pan presenting a smooth continuous molding surface for the full length thereof, said form pan section being constructed of molded plastic material and comprising a top wall, opposed side walls depending angularly outwardly from a respective side edge of said top wall, and a support flange extending outwardly along a bottom free edge of each of said side walls, each of said support flanges including a structural rib-like load supporting bearing section adjacent the respective side wall in underlying relation to a form defining top face, said load supporting bearing sections being capable of freely supporting a vertical load, structural ribs lying in vertical planes formed integral with inner surfaces of said top and side walls and imparting rigidity to said top and side walls to resist vertical and horizontal distortion when said top and side walls are subjected to loads, said form pan section having at least one open end, connecting means adjacent said open end inwardly of said top and side walls for connecting said one open end of said form pan section to a like open end of another form pan section as a longitudinal extension thereof and in end-to-end abutting relation and with outer surfaces of said top and side walls forming continuations of one another, and alignment means projecting from said open end for interlocking said form pan section with another form pan section in axial alignment therewith, said connecting means including an inwardly projecting connecting rib in each corner between one of said side walls and said top wall adjacent said one end and in longitudinally spaced relation thereto, said connecting ribs extending inwardly beyond said structural ribs and forming spacer means between stored stacked form pan sections, and tensioning bolt receiving means in each of said connecting ribs.

* * * * *